US007767035B2

(12) United States Patent
Sato et al.

(10) Patent No.: US 7,767,035 B2
(45) Date of Patent: Aug. 3, 2010

(54) METALLIC MAGNETIC MATERIAL FOR MAGNETIC ELEMENT OF A CHOKE COIL AND SMD CHOKE COIL

(75) Inventors: Namio Sato, Akita (JP); Yotaro Toyoshima, Akita (JP); Katsutoshi Yamamoto, Akita (JP)

(73) Assignee: Sekisin Industry Co., Ltd., Akita (JP)

( * ) Notice: Subject to any disclaimer, the term of this patent is extended or adjusted under 35 U.S.C. 154(b) by 228 days.

(21) Appl. No.: 11/947,886

(22) Filed: Nov. 30, 2007

(65) Prior Publication Data

US 2009/0095380 A1 Apr. 16, 2009

(30) Foreign Application Priority Data

Oct. 15, 2007 (JP) ..... 2007-267842

(51) Int. Cl.
*H01F 1/20* (2006.01)

(52) U.S. Cl. ..... 148/307; 148/105; 75/255

(58) Field of Classification Search ..... None
See application file for complete search history.

(56) References Cited

U.S. PATENT DOCUMENTS 4,543,208 A * 9/1985 Horie et al. ..... 252/62.54
4,956,011 A * 9/1990 Nishida et al. ..... 75/230
2005/0162331 A1 7/2005 Endo et al.
2006/0214132 A1* 9/2006 Hirata et al. ..... 252/62.54
2007/0252771 A1* 11/2007 Maezawa et al. ..... 343/841
2008/0191028 A1* 8/2008 Kagaya et al. ..... 235/492

FOREIGN PATENT DOCUMENTS

JP 2004-166175 6/2004

OTHER PUBLICATIONS

English Language abstract of JP 2004-166175.

* cited by examiner

*Primary Examiner*—John P Sheehan
(74) *Attorney, Agent, or Firm*—Greenblum & Bernstein, P.L.C.

(57) ABSTRACT

A metallic magnetic material for magnetic element for magnetic element of a choke coil and an SMD choke power coil for accommodating low voltage and high current in a personal computer, graphic card, high frequency power supply, etc, is prepared by baking a powder of Fe—Si—Al alloy sendust, obtained by an atomization process and having an average particle diameter of 10 to 70 μm, at 600° C. to 1000° C. in air or in an oxidizing atmosphere and mixing the baked sendust with 3 to 45 wt % of a carbonyl iron powder with an average particle diameter of 1 to 10 μm. The metallic magnetic material for magnetic element according to the present invention is used in a coil-embedded SMD power choke coil having a square or rectangular shape with a height of 1 mm to 7 mm and with a length of one side being 3 mm to 13 mm.

5 Claims, No Drawings

METALLIC MAGNETIC MATERIAL FOR MAGNETIC ELEMENT OF A CHOKE COIL AND SMD CHOKE COIL

FIELD OF THE INVENTION

The present invention relates to a metallic magnetic material for magnetic element of a choke coil and to an SMD power choke coil used for accommodating low voltage and high current in a personal computer, graphic card, high frequency power supply, etc.

DESCRIPTION OF THE PRIOR ART

Conventionally with an integral, coil-incorporated SMD power choke coil that accommodates low voltage and high current, a high saturation magnetic flux density and a high insulating property of the metallic magnetic powder itself are required to obtain a stable inductance value with respect to a DC bias (Japanese Published Unexamined Patent Application No. 2004-166175).

Metallic magnetic powders of high magnetic flux density, that is, permalloy powder, carbonyl iron powder, and sendust powder have been used in place of ferrite in embedded SMD power choke coils.

However, permalloy powder, which is Fe—Ni based, is high in raw material cost, and carbonyl iron powder, although having iron as a main component, has a high price several times that of iron powder and, due to being a fine powder with a particle diameter of 15 μm or less, makes preparation of a material with good insulation and fluidity among metal powder particles extremely difficult.

Iron powder itself, although inexpensive, is high in magnetic loss and is significantly poor in DC bias characteristics in comparison to permalloy, carbonyl iron powder, and sendust.

Meanwhile, sendust, which is Fe—Si—Al based, is comparatively inexpensive in material cost and provides a wide selection range of particle diameters from fine grain (average particle diameter of around 10 μm) to medium grain (average particle diameter of around 30 μm) and coarse grain (average particle diameter of around 70 μm).

With sendust powder, control of surface insulation resistance of alloy particles by surface oxidation and control of magnetic permeability can be achieved readily by baking in air, and as a metallic magnetic material for a coil-embedded SMD power choke, sendust powder provides a merit that interparticle insulation can be realized readily for a manufacturing process.

An object of the present invention is to provide a metallic magnetic material for magnetic element of a choke coil and an SMD power choke coil to be used for accommodating low voltage and high current in a personal computer, graphic card, high frequency power supply, etc.

SUMMARY OF THE INVENTION

A metallic magnetic material for magnetic element according to the present invention is prepared by baking a magnetic powder of Fe—Si—Al alloy sendust, obtained by an atomization process and having an average particle diameter of 10 to 70 μm, at 600° C. to 1000° C. in air or in an oxidizing atmosphere and mixing the baked sendust with 3 to 45 wt % of carbonyl iron powder with an average particle diameter of 1 to 10 μm.

The metallic magnetic material for magnetic element according to the present invention is used in a coil-embedded SMD power choke coil having a square or rectangular shape with a height of 1 mm to 7 mm and with a length of one side being 3 mm to 13 mm.

With the present invention, a coil-embedded power choke material is prepared by combining a main raw material of sendust powder with carbonyl iron powder and thereby made to have an excellent DC bias and a high insulating property, and control of the characteristics of various types of SMD power chokes is enabled by controlling the initial magnetic permeability μ of sendust through setting various baking conditions and by freely varying the mixing proportion of the carbonyl iron powder.

Because the initial magnetic permeability can be controlled readily to meet the high current, high DC bias, and inductance requirements of a power choke, a product suited to the purpose can be provided.

The present invention makes it possible to perform control of the initial magnetic permeability μ of the base metal powder, which was deemed to be a difficulty in the manufacture of coil-embedded SMD power choke coils, to lower the initial magnetic permeability of sendust, which is the base raw material, to no more than the initial magnetic permeability of the carbonyl iron powder in a magnetic core for a coil-embedded power choke that has a square or rectangular shape with a height being 1 mm to 7 mm and with a length of one side being 3 mm to 13 mm, to control as suited the shape, inductance, DC bias and other required characteristics, etc., of the coil-embedded SMD power choke required by the market by control of the mixing proportion of the carbonyl iron powder in sendust in a range of 3 to 45%, and to realize a product with which the insulation resistance of the embedded coil and the insulation resistance among the metallic magnetic powders that form the coil is 1.0 E+06 (Ω) or more.

DESCRIPTION OF THE PREFERRED EMBODIMENTS

Targeted Characteristics of the Invention

The present invention is targeted at obtaining a product, with which the magnetic characteristics of a magnetic powder compact are such that an initial magnetic permeability μ is approximately 20 and a DC bias is 80% or more.

When the DC bias is less than 80%, the functions of the product as a choke coil are lowered significantly.

It was found that the characteristics can be obtained by a mixed compound of sendust, which has been surface oxidized by heat treatment in air, and a carbonyl iron powder for increasing the initial magnetic permeability and density that are lowered by baking.

When sendust is baked, the initial magnetic permeability μ decreases and the DC bias increases.

However, in this state, an inductance that accommodates market requirements of low voltage and high current is difficult to obtain.

The lowered initial magnetic permeability μ is thus recovered while maintaining a high DC bias by mixing with a carbonyl iron powder.

Here, a carbonyl iron powder having a higher initial magnetic permeability μ than the initial magnetic permeability μ of the baked sendust is required.

Metallic Magnetic Material

Sendust is an Fe-9.6Si-5.4Al alloy and normally contains Si in a range of 8.3 to 11.5 wt % and Al in a range of 4.5 to 6.5 wt %. In regard to particle size, sendust samples with average particle diameters of approximately 5 to 90 μm were prepared.

Carbonyl iron powder has the form of microscopic spheres of high-purity iron that are chemically prepared from iron carbonyl. In regard to content ranges of impurities, no more than 0.1 wt % of C (carbon) and no more than 0.1 wt % of O (oxygen) are contained. As long as the purity and the shape are the same, the same effects can be obtained even if the preparation methods differ. Samples with particle diameters of 0.3 to 15 μm were prepared and subject to experiments.

"Iron powder" generally refers to a powder of electrolytic iron, Armco iron, etc., and the purity thereof is not as high as that of carbonyl iron. "Fe-3.5Si alloy" refers to silicon iron for magnetic applications and normally contains 2.5 to 4.5 wt % of Si.

"Fe-50Ni alloy" refers to a type 3 permalloy (JIS H 2531 PB grade) according to JIS H 4532 with an Ni content range of normally 40 to 52 wt %. "Fe-3.5Si-4.5Cr alloy" refers to an alloy containing 3 to 4 wt % Si and 4 to 5 wt % Cr.

Particle Size of Sendust and Carbonyl Iron Powder

With the present invention, sendust is heated at a high temperature in air or an oxidizing atmosphere to adjust the magnetic characteristics (initial magnetic permeability).

At the same time, an appropriate insulating film, mainly constituted of aluminum oxide ($Al_2O_3$), is deposited on the surface of the sendust powder.

Sendust powders were heated in air and minimum heating temperatures for obtaining an appropriate magnetic characteristics and insulating property were measured.

The results are shown in Table 1.

TABLE 1

Results of heating sendust in air

| | Average particle diameter (μm) | | | | | |
|---|---|---|---|---|---|---|
| | 5 | 10 | 40 | 60 | 70 | 90 |
| Temperature of oxidizing atmosphere (° C.) (temperature for obtaining μ of 25 or less) | 600 | 600 | 700 | 750 | 1000 | 1000 |
| Insulating property | 600° C. | 600° C. | 600° C. | 600° C. | 600° C. | 600° C. |
| Evaluation | NG | Yes | Yes | Yes | Yes | NG |

In Table 1, the oxidizing atmosphere temperature was set to that at which an initial magnetic permeability μ of 25 or less is obtained. In regard to the insulating property, judgments were made with the condition that an insulation resistance of 1.0 E+08 (Ω) be obtained.

When the average particle diameter of the sendust powder is less than 10 μm, combustion occurs readily during baking and when, in the case where the average particle diameter is 5 μm, heating in air at a baking temperature of 600° C. is performed to obtain the magnetic characteristics (initial magnetic permeability), excessive oxidation occurs and the appropriate characteristics cannot be obtained (in a non-oxidizing atmosphere, there are no problems with a temperature of 600° C.). To obtain the appropriate surface insulating property, heating in air to 600° C. or more is necessary.

When the average particle diameter exceeds 70 μm, the baking temperature for obtaining the appropriate magnetic characteristics (initial magnetic permeability) rises to 1100° C. and becomes unsuitable for normal production.

Although a higher heating temperature enables a higher value of the insulating property to be obtained, a heating temperature of 1000° C. or less is preferable for industrial production.

From the results of Table 1, the appropriate average particle diameter of sendust is 10 μm or more and 70 μm or less.

In regard to the carbonyl iron powder, tests of properties of mixing with sendust and forming by a press were conducted on powders with average particle diameters in a range of 0.3 to 15 μm.

The results are shown in Table 2.

TABLE 2

Characteristics of carbonyl iron powder

| | Average particle diameter (μm) | | | | |
|---|---|---|---|---|---|
| | 0.3 | 1 | 5 | 10 | 15 |
| Mixing and forming properties | Mixing properties NG | Yes | Yes | Yes | Press forming properties NG |
| Initial magnetic permeability μ | 15 | 20 | 26 | 35 | 40 |

For combination with sendust, the carbonyl iron powder is required to have an initial magnetic permeability μ of 25 or more. At an average particle diameter of 0.3 μm, the mixing property and the initial magnetic permeability μ are not suitable for use, and when the average particle diameter becomes 15 μm, the carbonyl iron powder particles do not enter well between the sendust particles and the forming property is poor.

From the results of Table 2, the appropriate average particle diameter range of the carbonyl iron powder is 1 μm or more and 10 μm or less.

As a necessity, the lower limit of the initial magnetic permeability μ is 20 and the upper limit is 35.

EXAMPLES OF PREPARATION OF EXAMPLE SAMPLES

Experimental results concerning sendust powders, with average particle diameters of 40 μm and 60 μm that are within the appropriate average particle diameter range for sendust of 10 μm or more and 70 μm or less, and examples of using a carbonyl iron powder, with an average particle of 5 μm that is within the appropriate average particle diameter range for carbonyl iron powder of 1 μm or more and 10 μm or less, shall now be described.

In an unbaked state, the sendust powder with the average particle diameter of 40 μm had an initial magnetic permeability μ of 37.2, and the sendust powder with the average particle diameter of 60 μm had an initial magnetic permeability μ of 39.1. The initial magnetic permeability μ of the carbonyl iron powder with the average particle diameter of 5 μm was 26.4.

Each of the sendust powders is baked in air or an oxidizing atmosphere to make the initial magnetic permeability μ thereof 10 to 25 by mixing with the carbonyl iron powder of the initial magnetic permeability μ of 26.4.

To prepare the metallic magnetic material for magnetic element, 1 to 3 wt % of powder epoxy, 1 to 3 wt % of talc, and 2 to 4 wt % of epoxy-based varnish for improving the forming property and the insulating property were added to the mixed material.

In regard to the carbonyl iron powder, a portion of the carbonyl iron powder may be replaced, in a range of 0 to 50 wt %, by any one or a mixed powder of another iron powder, Fe-3.5Si alloy, Fe-50Ni alloy, and Fe-3.5Si-4.5Cr alloy with an average particle diameter of 1 to 10 μm.

The metallic magnetic material for magnetic element according to the present invention shall now be described in detail below.

The sendust powder with the average particle diameter of 60 μm and the sendust powder with the average particle diameter of 40 μm were respectively baked in air at 600 to 1000° C. for a stabilization time of 15 minutes and thereafter crumbled by sieving through a 355 μm screen. Because the baked sendust powder and the carbonyl iron powder are not suitable for forming as they are, samples for measurement of the initial magnetic permeability μ and the insulation resistance were prepared as follows.

To 100 wt % of each of the carbonyl iron powder and the baked sendust powders that are respectively to be the main component and had been adjusted to provide various values of the initial magnetic permeability in an oxidizing atmosphere, 2 wt % of powder epoxy was added, and after mixing by stirring for two minutes, 1 wt % of epoxy varnish was added and then mixing by stirring was performed for 30 minutes.

After drying each mixed material for 30 minutes in an oven set at 70° C. to 80° C., the mixed material was passed through a 355 μm screen to prepare grains.

As each measurement sample, the grains were compacted at a compacting pressure of 5 ton/cm$^2$ to a toroidal shape with an outer diameter of 10 mmΦ, an inner diameter of 5 mmΦ, and a weight of 1 g and then hardened at 170° C. for 30 minutes.

After first measuring the compact density and the insulation resistance, a 0.4 mmΦ wire was wound 10 times around each toroid, the inductance was measured by an LCR meter, and the initial magnetic permeability Ξ was computed.

Data of the relationship of the respective initial magnetic permeabilities μ, insulation resistances, and compact densities of the baked and unbaked sendust powders and the carbonyl iron powder are shown in Table 3.

TABLE 3

Initial magnetic permeabilities μ of carbonyl iron powder and baked sendust

| Raw material | Average particle diameter (μm) | Baking temperature (° C.) | Initial magnetic permeability μ | Insulation resistance (Ω) | Compact density (g/cm3) |
|---|---|---|---|---|---|
| Carbonyl | 5 | Unbaked | 26.4 | 1.E+00 | 6.07 |
| Sendust | 40 | Unbaked | 37.2 | 1.E+00 | 5.36 |
| | | 600 | 29.6 | 1.E+08 | 5.27 |
| | | 700 | 25.2 | 1.E+11 | 5.17 |
| | | 750 | 23.0 | 1.E+11 | 5.11 |
| | | 800 | 20.2 | 1.E+12 | 5.07 |
| | | 850 | 17.8 | 1.E+12 | 5.02 |
| | | 900 | 15.7 | 1.E+12 | 4.92 |
| | | 950 | 14.2 | 1.E+12 | 4.89 |
| | | 1000 | 13.0 | 1.E+12 | 4.88 |
| | 60 | Unbaked | 39.1 | 1.E+00 | 5.43 |
| | | 700 | 28.3 | 1.E+10 | 5.35 |
| | | 750 | 26.1 | 1.E+11 | 5.27 |
| | | 800 | 24.2 | 1.E+11 | 5.18 |
| | | 850 | 20.6 | 1.E+12 | 5.11 |
| | | 900 | 16.8 | 1.E+12 | 5.00 |
| | | 950 | 15.2 | 1.E+12 | 4.95 |
| | | 1000 | 14.7 | 1.E+12 | 4.93 |

The initial magnetic permeability μ of sendust could be made smaller than the initial magnetic permeability μ of the carbonyl iron powder by baking at 700° C. or more when average particle diameter was 40 μm and at 750° C. or more when the average particle diameter was 60 μm.

When sendust with an average particle diameter of 10 μm was baked at 1000° C., the initial magnetic permeability μ was 10. This is the lowest possible value that can be used.

Table 3 shows that the smaller the average particle diameter, the more readily the initial magnetic permeability μ of sendust is lowered.

With the baked sendust, as the temperature increases, the density and the initial magnetic permeability μ decrease and the strength also weakens.

Although it is generally known that as the initial magnetic permeability μ is lowered, the DC bias characteristics are improved, because the inductance is lowered as well, a material that can both provide the merit and compensate for the demerit is required.

If in order to compensate for the lowering of inductance, the number of windings of a coil is increased, the DC resistance and heat generation increase and thus a large current cannot be made to flow.

Carbonyl iron powder is thus mixed to the sendust powder that has been made lower in initial magnetic permeability μ than the carbonyl iron powder to increase the density and thereby attempted is to confine much of the magnetic powder, recover the inductance, and improve the DC bias at the same time.

Details of compound materials, in which the carbonyl iron powder and the sendust powders of Table 3 are mixed, shall now be described. To the total weight parts, that is, the sum of sendust and carbonyl iron powder being 100 wt % talc was added, and five types of compound materials were prepared in which 0 wt %, 10 wt %, 25 wt %, 45 wt % and 55 wt % of carbonyl iron powder were respectively mixed.

For improvement in strength after hardening by heating and for stabilization of the insulating property, it was found that addition of 1 to 3 wt % of talc was satisfactory. The added amount of talc does not necessarily have to be 1 to 3 wt % and the amount of epoxy varnish may be increased instead.

To the total weight parts of each of the five types of mixed powder material, 1 to 3 wt % of epoxy powder was weighed and added and mixing by stirring was performed for approximately two minutes.

2 to 4 wt % of the epoxy varnish, 0.3 wt % of tin metal soap, and 2.5 vol % of MEK were weighed and added to the total weight parts and stirring was performed for 60 minutes.

The tin metal soap is for moisture adjustment of the material and is not necessarily required if the material is used within a short period.

Each of the compound materials thus prepared was passed through a 250 μm sieve and then dried at 80° C. for 2 Hr for improvement in fluidity.

Each of the dried mixed powders was then loosened apart by passing through a 355 μm sieve, and compound material grains of metallic magnetic materials for magnetic element were thus prepared.

Results of measuring the initial magnetic permeabilities, insulation resistances, and compact densities of the five types of compound materials in which 0 to 55 wt % of carbonyl were mixed are shown respectively in Table 4 (initial magnetic permeabilities μ of the compound materials), Table 5 (insulation resistances Ω of the compound materials), and Table 6 (compact densities g/cm$^3$ of the compact materials).

As with the sample used for measurement of the baked powders, each sample was prepared by compacting at a compacting pressure of 5 ton/cm$^2$ to a toroidal shape with an outer diameter of 10 mmΦ, an inner diameter of 5 mmΦ, and a weight of 1 g and then hardening at 170° C. for 30 minutes.

Also as with the measurements made on the baked powders, for the initial magnetic permeability μ, a 0.4 mmΦ wire was wound 10 times around each toroid, the inductance was measured by an LCR meter, and the initial magnetic permeability μ was computed.

The packing density obviously differs according to the compacting pressure. Although examples where the compacting pressure is set to 5 ton/cm$^2$ are shown here, a compacting pressure in a range of 3 to 8 ton/cm$^2$ can be selected for manufacture.

TABLE 4

Initial magnetic permeabilities μ of compound materials

| Average particle diameter of sendust | Baking temperature (° C.) | Mixed amount of carbonyl (wt %) 0 | 10 | 25 | 45 | 55 |
|---|---|---|---|---|---|---|
| 40 | 700 | 23.2 | 24.5 | 25.3 | 26.1 | 26.2 |
| | 750 | 20.7 | 21.5 | 23.9 | 25.8 | 26.0 |
| | 800 | 18.8 | 20.8 | 23.1 | 24.0 | 25.4 |
| | 850 | 16.4 | 18.0 | 20.3 | 21.5 | 23.0 |
| | 900 | 14.4 | 15.9 | 17.7 | 19.3 | 20.5 |
| | 950 | 13.6 | 15.1 | 16.7 | 18.2 | 19.3 |
| | 1000 | 12.5 | 14.0 | 15.5 | 17.0 | 18.0 |
| 60 | 700 | 24.2 | 25.1 | 26.0 | 26.2 | 26.3 |
| | 750 | 21.5 | 23.9 | 25.1 | 25.3 | 26.2 |
| | 800 | 19.6 | 23.2 | 24.3 | 24.5 | 25.4 |
| | 850 | 17.5 | 19.3 | 21.3 | 22.6 | 23.2 |
| | 900 | 15.4 | 16.9 | 18.9 | 20.7 | 21.0 |
| | 950 | 14.5 | 15.8 | 17.5 | 19.3 | 19.3 |
| | 1000 | 14.0 | 15.2 | 16.8 | 17.8 | 18.0 |

TABLE 5

Insulation resistances (Ω) of compound materials

| Average particle diameter of sendust | Baking temperature (° C.) | Mixed amount of carbonyl (wt %) 0 | 10 | 25 | 45 | 55 |
|---|---|---|---|---|---|---|
| 40 | 700 | 1.E+11 | 1.E+11 | 1.E+08 | 1.E+06 | 1.E+04 |
| | 750 | 1.E+12 | 1.E+12 | 1.E+08 | 1.E+06 | 1.E+04 |
| | 800 | 1.E+12 | 1.E+12 | 1.E+08 | 1.E+06 | 1.E+05 |
| | 850 | 1.E+12 | 1.E+12 | 1.E+09 | 1.E+06 | 1.E+05 |
| | 900 | 1.E+12 | 1.E+12 | 1.E+09 | 1.E+06 | 1.E+05 |
| | 950 | 1.E+12 | 1.E+12 | 1.E+09 | 1.E+06 | 1.E+05 |
| | 1000 | 1.E+12 | 1.E+12 | 1.E+09 | 1.E+06 | 1.E+05 |
| 60 | 700 | 1.E+11 | 1.E+11 | 1.E+07 | 1.E+06 | 1.E+04 |
| | 750 | 1.E+11 | 1.E+11 | 1.E+08 | 1.E+06 | 1.E+04 |
| | 800 | 1.E+12 | 1.E+11 | 1.E+08 | 1.E+06 | 1.E+05 |
| | 850 | 1.E+12 | 1.E+12 | 1.E+08 | 1.E+06 | 1.E+05 |
| | 900 | 1.E+12 | 1.E+12 | 1.E+08 | 1.E+06 | 1.E+05 |
| | 950 | 1.E+12 | 1.E+12 | 1.E+08 | 1.E+06 | 1.E+05 |
| | 1000 | 1.E+12 | 1.E+12 | 1.E+08 | 1.E+06 | 1.E+05 |

TABLE 6

Compact densities (g/cm$^3$) of compound materials

| Average particle diameter of sendust | Baking temperature (° C.) | Mixed amount of carbonyl (wt %) 0 | 10 | 25 | 45 | 55 |
|---|---|---|---|---|---|---|
| 40 | 700 | 5.160 | 5.310 | 5.420 | 5.490 | 5.530 |
| | 750 | 5.120 | 5.280 | 5.400 | 5.470 | 5.510 |

TABLE 6-continued

Compact densities (g/cm$^3$) of compound materials

| Average particle diameter of sendust | Baking temperature (° C.) | Mixed amount of carbonyl (wt %) 0 | 10 | 25 | 45 | 55 |
|---|---|---|---|---|---|---|
| | 800 | 5.070 | 5.220 | 5.370 | 5.460 | 5.490 |
| | 850 | 4.982 | 5.122 | 5.308 | 5.447 | 5.480 |
| | 900 | 4.946 | 5.072 | 5.243 | 5.415 | 5.480 |
| | 950 | 4.902 | 5.030 | 5.220 | 5.389 | 5.480 |
| | 1000 | 4.890 | 5.010 | 5.200 | 5.370 | 5.470 |
| 60 | 700 | 5.220 | 5.300 | 5.400 | 5.490 | 5.535 |
| | 750 | 5.150 | 5.260 | 5.390 | 5.485 | 5.530 |
| | 800 | 5.087 | 5.230 | 5.380 | 5.485 | 5.525 |
| | 850 | 5.042 | 5.190 | 5.360 | 5.479 | 5.510 |
| | 900 | 4.988 | 5.119 | 5.313 | 5.465 | 5.505 |
| | 950 | 4.950 | 5.080 | 5.283 | 5.429 | 5.490 |
| | 1000 | 4.940 | 5.060 | 5.260 | 5.410 | 5.480 |

In Table 4, the initial magnetic permeabilities U of the compound materials without the carbonyl iron powder added exhibit an apparent decrease with respect to baked sendust.

This is because the baked sendust described on page 12, line 3 to page 13, last line and the compound materials described on page 15, line 22 to page 17, line 4 differ in the contents of the materials added to optimize integral forming of a coil.

It can be understood that by varying the sendust baking temperature and the carbonyl mixing amount, the initial magnetic permeability μ of the compound material can be controlled readily and that these conditions can be combined freely.

Here, the initial magnetic permeability μ of sendust after baking is used for the purpose of controlling the DC bias of the product, and the initial magnetic permeability μ of the compound material is used for control of inductance in process control.

The DC bias is improved by adding the carbonyl iron powder to sendust, and this is controlled according to the initial magnetic permeability μ. It is important that the initial magnetic permeability μ of the carbonyl iron powder that is added be equal to or greater than that of sendust.

In other words, the initial magnetic permeability μ of sendust is no more than that of the carbonyl iron powder.

When the initial magnetic permeability μ of sendust exceeds that of the carbonyl iron powder, an appropriate DC bias cannot be obtained.

Although with sendust having a high initial magnetic permeability μ, a large inductance can be obtained, oppositely, the DC bias degrades.

Although in order to make the inductance suit market requirements while using sendust with a high initial magnetic permeability μ, an inorganic or organic insulating substance is added, the number of windings of a coil is decreased, or the compacting pressure is lowered, the DC bias of sendust with a high initial magnetic permeability μ does not reach a targeted value.

When the initial magnetic permeability μ of sendust is lowered by baking to start with, although the DC bias rises to 90% in a region of low initial magnetic permeability μ of 10 to 25, the inductance oppositely does not reach the market-required value.

It thus becomes necessary to increase the inductance, and this requires mixing in of a microparticulate carbonyl iron powder having a high initial magnetic permeability μ that is no less than and does not further lower the initial magnetic permeability μ of baked sendust and can increase the density by entering into the particle gaps of the sendust.

Table 5 shows that when an insulation resistance of 1.0 E+06 (Ω) or more is targeted, up to a maximum of 45 wt % of the carbonyl iron powder can be mixed.

The value of 45 wt % is that for the case where the initial magnetic permeability μ of the carbonyl iron powder is around 26.4 (Table 3), and when the initial magnetic permeability μ takes on a value of 20 or 30, 35, etc., the mixing amount increases or decreases correspondingly and obviously, the maximum value of the mixing amount increase or decreases correspondingly.

Because the insulation resistance decreases when the carbonyl iron powder is mixed, the insulation resistance of Table 3 that is obtained by the baking of sendust should be 1.0 E+8 (Ω) or more and preferably 1.0 E+10 (Ω) or more.

Table 6 shows that although with sendust, the higher the baking temperature, the lower the compacting density, the density is increased by the mixing in of the carbonyl iron powder.

That is, because a larger amount of the magnetic powder can be confined, the inductance can be increased even if the initial magnetic permeability μ of sendust is low.

Results of examining an optimal relationship of the sendust baking temperature and the carbonyl mixing amount derived from the above measurement results for the compound materials shall now be described.

A representative sample was made to have a shape of (10 mm×10 mm square)×4 mm height and a coil, with which 3.5 Ts of a rectangular wire of 1.8 mm width×0.5 mm thickness are wound, was integrally compacted at a compacting pressure of 5 ton/cm$^2$.

After compacting, hardening by heating at 170° C. for 60 minutes was performed to prepare the measurement sample.

The DC bias characteristics with this shape were such that with respect to an inductance of 0.5 μH in a 0A state, the maximum value that could be obtained conventionally was 0.4 μH in a 40A state.

Thus in this case, the DC bias value is calculated as: [inductance in the 40A state (L40A)/inductance in the 0A state (LOA)]×100, and the DC bias is expressed as 80%.

Because an inductance of 0.5 μH is not necessarily obtained with all of the above-described compound materials, the inductances and DC biases of all of the compound materials were measured, and the results of determining the DC bias values at points that meet the condition of 0.5 μH are shown in Table 7.

TABLE 7

Relationship between DC bias, carbonyl mixing amount, and initial magnetic permeability μ of sendust in the case of a 10 × 10 × 4 (0.5 μH) sample

| Average particle diameter of sendust | Item | Carbonyl mixing amount (wt %) 0 | 3 | 10 | 25 | 45 |
|---|---|---|---|---|---|---|
| 40 | DC bias % | 77 | 80 | 82 | 84 | 88 |
| | Corresponding baking temperature (° C.) | 770 | 810 | 830 | 880 | 950 |
| | μ of compound material | 20.5 | 21.0 | 19.5 | 19 | 17 |
| 60 | DC bias % | 78 | 81 | 82 | 86 | 90 |
| | Corresponding baking temperature (° C.) | 820 | 840 | 860 | 930 | 1000 |

TABLE 7-continued

Relationship between DC bias, carbonyl mixing amount, and initial magnetic permeability μ of sendust in the case of a 10 × 10 × 4 (0.5 μH) sample

| Average particle diameter of sendust | Item | Carbonyl mixing amount (wt %) 0 | 3 | 10 | 25 | 45 |
|---|---|---|---|---|---|---|
| | μ of compound material | 19.5 | 19.5 | 19 | 18.5 | 17.8 |

The results of Table 7 show that the limit of the DC bias for sendust alone, that is, for a carbonyl iron powder mixing amount of 0 wt % is 78%, and that unless 3 wt % or more of the carbonyl iron powder is mixed, a DC bias of 80% cannot be attained.

Although the higher the carbonyl iron powder mixing amount, the more improved the DC bias, as mentioned above, when 45 wt % is exceeded, the insulation resistance decreases (Table 5).

The preferable range of the carbonyl iron powder mixing amount is thus 3 to 45 wt %.

Here, in noting the initial magnetic permeabilities p of the compound materials, although it was thought that if the inductance is fixed at 0.5 μH, the initial magnetic permeability μ is also fixed, the initial magnetic permeability μ actually decreases as the carbonyl iron powder mixing amount increases.

The reason for this is not made clear.

Furthermore, the initial magnetic permeability μ and the DC bias value of baked sendust are substantially matched regardless of the average particle diameter of sendust. It is thus sufficient to adjust the initial magnetic permeability μ of baked sendust regardless of the average particle diameter.

Because the initial magnetic permeability μ of baked sendust varies with the baking temperature, atmosphere, time, and particle diameter, it is not necessarily satisfactory to perform baking at a temperature shown in Table 7, and a baking method by which the targeted initial magnetic permeability μ is obtained should be employed.

Table 8 shows results of testing whether the material obtained by the present method exhibits excellent DC bias with other SMD power choke coil shapes and inductance values.

Here, differences unique to shape were found, and for a shape of 6.5 mm square×3 mm height, a compound material, with which the initial magnetic permeability μ of sendust is 14 and the mixing amount of carbonyl is 25 wt %, was appropriate.

TABLE 8

Examples of DC bias characteristics of other shapes

| Shape | Inductance (μH) | DC bias (%) | Material conditions |
|---|---|---|---|
| 6.5 mm square × 3 mm height | 1.0 | 86% (in a 20 A DC state) | μ of baked sendust: 14 Carbonyl: 25 wt % |
| | 10.0 | 83% (in a 7 A DC state) | |
| 4.5 mm square × 1 mm height | 1.5 | 86% (in a 3.3 A DC state) | μ of baked sendust: 17 Carbonyl: 25 wt % |

Here, the values of the applied current are the maximum current values for which the DC bias falls within 75 to 80% under conventional circumstances.

However, the mixed material of baked sendust and carbonyl iron powder exceeds this limit.

Thus for differences unique to shape and differences in inductance value, the targeted DC bias can be accommodated freely by changing the initial magnetic permeability μ by baking of sendust and changing the mixing amount of carbonyl iron powder.

How the DC bias changes when, in a mixture of baked sendust and 3 to 45 wt % carbonyl iron powder, a portion of the carbonyl iron powder is replaced by another metallic magnetic powder was then examined.

The metallic magnetic powders used for replacement were of four types, that is, pure iron, Fe-3.5Si alloy, Fe-50Ni alloy, and Fe-3.5Si-4.5Cr alloy, and powders of these types with an average particle diameter of 1 to 10 μm were used.

Examples of replacing a portion of the carbonyl iron powder (25 wt %) while using the baked sendust (average particle diameter: 40 μm; baking temperature: 880° C.) of Table 7 shall now be described.

The carbonyl iron powder used here is the same as that of Table 3.

The compound material preparation method is the same as that of the above-described experiment (page 15, line 22 to page 17, line 4) and with each sample, the above-described metallic magnetic powder, replacing a weight part of the carbonyl at a weight proportion (replacement percentage) of 0 to 60% with respect to the carbonyl iron powder, was blended in.

The sample shape and the measurement method are the same as those of the above-described experiment (page 23, line 14 to page 24, last line).

The DC bias measurement results are shown in Tables 9 to 12. The particle size of the added replacement alloy is 10 μm.

TABLE 9

DC bias of 10 × 10 × 4 (0.5 μH) sample with carbonyl iron powder being replaced by electrolytic iron (Fe)

| Mixed material | | | | | | |
|---|---|---|---|---|---|---|
| Carbonyl Average | Fe Average particle diameter: 10 μm | | | | | |
| particle diameter: 5 μm (Wt %) | (Wt %) | Replacement percentage (%) | Total of mixed material (Wt %) | μ of baked sendust | DC bias (%) (in a 40 A state) | μ of compound material |
| 25.00 | 0 | 0 | 25 | 17 (880° C.) | 84 | 19.0 |
| 24.75 | 0.25 | 1 | 25 | 17 | 84 | 19.0 |
| 18.75 | 6.25 | 25 | 25 | 17 | 83 | 19.0 |
| 12.50 | 12.50 | 50 | 25 | 17 | 82 | 19.5 |
| 10.00 | 15.00 | 60 | 25 | 17 | 77 | 19.9 |

TABLE 10

DC bias of 10 × 10 × 4 (0.5 μH) sample with carbonyl iron powder being replaced by Fe—3.5Si alloy

| Mixed material | | | | | | |
|---|---|---|---|---|---|---|
| Carbonyl Average | Fe—3.5Si Average particle diameter: 10 μm | | | | | |
| particle diameter: 5 μm (Wt %) | (Wt %) | Replacement percentage (%) | Total of mixed material (Wt %) | μ of baked sendust | DC bias (%) (in a 40 A state) | μ of compound material |
| 25.00 | 0 | 0 | 25 | 17 (880° C.) | 84 | 19.0 |
| 24.75 | 0.25 | 1 | 25 | 17 | 84 | 19.0 |
| 18.75 | 6.25 | 25 | 25 | 17 | 84 | 19.0 |
| 12.50 | 12.50 | 50 | 25 | 17 | 83 | 19.5 |
| 10.00 | 15.00 | 60 | 25 | 17 | 77 | 19.6 |

TABLE 11

DC bias of 10 × 10 × 4 (0.5 μH) sample with carbonyl iron powder being replaced by Fe—50Ni alloy

| Mixed material | | | | | | |
|---|---|---|---|---|---|---|
| Carbonyl Average | Fe—50Ni Average particle diameter: 10 μm | | | | | |
| particle diameter: 5 μm (Wt %) | (Wt %) | Replacement percentage (%) | Total of mixed material (Wt %) | μ of baked sendust | DC bias (%) (in a 40 A state) | μ of compound material |
| 25.00 | 0 | 0 | 25 | 17 (880° C.) | 84 | 19.0 |
| 24.75 | 0.25 | 1 | 25 | 17 | 84 | 19.0 |
| 18.75 | 6.25 | 25 | 25 | 17 | 85 | 19.0 |
| 12.50 | 12.50 | 50 | 25 | 17 | 85 | 19.5 |
| 10.00 | 15.00 | 60 | 25 | 17 | 78 | 19.8 |

TABLE 12

DC bias of 10 × 10 × 4 (0.5 μH) sample with carbonyl iron powder being replaced by Fe—3.5Si—4.5Cr alloy

| Mixed material | | | | | | |
|---|---|---|---|---|---|---|
| Carbonyl Average | Fe—3.5Si—4.5Cr Average particle diameter: 10 μm | | | | | |
| particle diameter: 5 μm (Wt %) | (Wt %) | Replacement percentage (%) | Total of mixed material (Wt %) | μ of baked sendust | DC bias (%) (in a 40 A state) | μ of compound material |
| 25.00 | 0 | 0 | 25 | 17 (880° C.) | 84 | 19.0 |
| 24.75 | 0.25 | 1 | 25 | 17 | 84 | 19.0 |
| 18.75 | 6.25 | 25 | 25 | 17 | 84 | 19.0 |
| 12.50 | 12.50 | 50 | 25 | 17 | 83 | 19.5 |
| 10.00 | 15.00 | 60 | 25 | 17 | 77 | 19.7 |

Tables 9 to 12 show that even when a portion of the carbonyl iron powder to be mixed with baked sendust is replaced at 0 to 50% by the electrolytic iron powder (Fe), Fe-3.5Si alloy, Fe-50Ni alloy, or Fe-3.5Si-4.5Cr alloy, the DC bias exceeds 80% in all cases and mixing can thus be performed within this replacement percentage range.

The DC bias exceeds 80% with a mixture of any of the four types of powders, and the DC bias was found to be 80% or more even when two to four types of the powders are mixed.

It was also found that with all of the alloys, replacement and addition in the excess of 50% is inappropriate in that it leads to the falling of the DC bias below 80%.

The present invention enables the attainment of a DC bias of 80% or more at a large current in SMD power choke coils of various shapes, which was difficult to achieve conventionally.

As principal technical grounds of improvement in the magnetic characteristics, the following are presumed in general.

That is, by subjecting the Fe—Si—Al sendust, which is the main material, to oxidation treatment in air or an oxidizing atmosphere and thereby oxidized are the respective metals making up the alloy, the surface resistance of the alloy particles is increased significantly, and as a collateral effect, the magnetic characteristics are lowered.

When sendust is oxidized at a high temperature in air, such oxides as $Al_2O_3$, $SiO_2$, $Fe_3O_4$, $Fe_2O_3$, etc., are formed, and $Al_2O_3$ and $SiO_2$ mainly contribute to the improvement in the insulating property.

By baking so that the initial value of initial magnetic permeability μ of 35 or more before the oxidation treatment becomes 25 or less and causing oxidation reactions to occur, the DC bias characteristics are improved and the surface resistance of the sendust alloy particles is also increased significantly.

Although due to the initial magnetic permeability μ and the density being small, the inductance is lowered, it is considered that by compensating for this demerit and increasing the density by means of the carbonyl iron powder in the SMD power choke coil, the inductance is recovered while maintaining an excellent DC bias.

Although an epoxy resin, etc., is coated to increase the insulation resistance of metal powder particles, as a result of the surface resistance of sendust powder being increased greatly by baking, the insulation performance dependent on the resin coating is no longer so important, and because the carbonyl iron powder can be mixed in an untreated state without lowering its initial magnetic permeability μ, adequate inductance and insulation resistance can be secured at 45 wt % or less.

The present invention makes it possible to perform control of the initial magnetic permeability μ of the base metal powder, which was deemed to be a difficulty in the manufacture of coil-embedded SMD power choke coils, to lower the initial magnetic permeability μ of sendust, which is the base raw material, to no more than the initial magnetic permeability μ of the carbonyl iron powder in a magnetic core for a coil-embedded power choke that has a square or rectangular shape with a height being 1 mm to 7 mm and with a length of one side being 3 mm to 13 mm, to control as suited the shape, inductance, DC bias and other required characteristics, etc., of the coil-embedded SMD power choke required by the market by control of the mixing proportion of the carbonyl iron powder in sendust in a range of 3 to 45 wt %, and to realize a product with which the insulation resistance of the embedded coil and the insulation resistance among the metallic magnetic powders that form the coil is 1.0 E+06 (Ω) or more.

What is claimed is:

1. A metallic magnetic material for a magnetic element of a choke coil, the metallic magnetic material being prepared by baking an Fe—Si—Al alloy sendust powder, obtained by an atomization process and having an average particle diameter of 10 to 70 μm, at 600° C. to 1000° C. in air or an oxidizing atmosphere, and mixing the baked sendust with 3 to 45 wt % of a carbonyl iron powder having an average particle diameter of 1 to 10 μm and an initial magnetic permeability μ of 20 to 35.

2. The metallic magnetic material for a magnetic element of a choke coil according to claim 1, prepared by baking the sendust powder having an average particle diameter of 10 to 70 μm at 600° C. to 1000° C. in air or the oxidizing atmosphere to obtain a baked sendust powder having an initial magnetic permeability μ of 10 or higher, wherein the initial magnetic permeability μ of the carbonyl iron powder is higher than the initial magnetic permeability μ of the sendust powder; and mixing the baked sendust powder with the carbonyl iron powder.

3. The metallic magnetic material for magnetic element of a choke coil according to claim 1, wherein 1 to 3 wt % of powder epoxy, 1 to 3 wt % of talc, and 2 to 4 wt % of epoxy-based varnish are added to the metallic magnetic material for a magnetic element.

4. The metallic magnetic material for a magnetic element of a choke coil according to claim 1, wherein a portion of the 3 to 45 wt % carbonyl iron powder is replaced, in a range of 0 to 50 wt %, by any one or a mixed powder of another electrolytic iron powder, Fe-3.5Si alloy, Fe-50Ni alloy, and Fe-3.5Si-4.5Cr alloy with an average particle diameter of 1 to 10 μm.

5. An SMD choke coil comprising the metallic magnetic material for a magnetic element of a choke coil according to claim 1 and having a square or rectangular shape with a height of 1 mm to 7 mm and with a length of one side being 3 mm to 13 mm.

* * * * *